United States Patent [19]

Bordt et al.

[11] Patent Number: 4,928,661

[45] Date of Patent: May 29, 1990

[54] COCKING DEVICE FOR A COMPRESSED AIR WEAPON

[75] Inventors: Wolfgang Bordt, Ulm; Friedrich Gerstenberger, Duernach, both of Fed. Rep. of Germany

[73] Assignee: J. G. Anschuetz GmbH, Ulm, Fed. Rep. of Germany

[21] Appl. No.: 324,666

[22] Filed: Mar. 17, 1989

[30] Foreign Application Priority Data

Mar. 18, 1988 [DE] Fed. Rep. of Germany ..... 3809239

[51] Int. Cl.[5] ..... F41B 11/00

[52] U.S. Cl. ..... 124/69; 124/80; 74/106

[58] Field of Search ..... 124/61, 63–65, 124/67–70, 80; 417/464, 903; 74/106, 520

[56] References Cited

U.S. PATENT DOCUMENTS

| | | | |
|---|---|---|---|
| 1,065,556 | 6/1913 | Searle | 124/67 |
| 3,142,199 | 7/1964 | Burton et al. | 74/520 X |
| 4,844,046 | 7/1989 | Straub | 124/69 X |

FOREIGN PATENT DOCUMENTS

| | | | |
|---|---|---|---|
| 2316317 | 3/1974 | Fed. Rep. of Germany | 124/69 |
| 0214917 | 10/1984 | Fed. Rep. of Germany | 124/56 |
| 1069504 | 11/1959 | German Democratic Rep. | 124/67 |
| 0025939 | of 1907 | United Kingdom | 124/67 |
| 0193215 | 2/1923 | United Kingdom | 417/464 |
| 0476005 | 11/1937 | United Kingdom | 124/69 |

*Primary Examiner*—Randolph A. Reese
*Assistant Examiner*—Jeffrey L. Thompson
*Attorney, Agent, or Firm*—Fleit, Jacobson, Cohn, Price, Holman & Stern

[57] ABSTRACT

A cocking device for a compressed air weapon employing pre-compressed air, wherein a cocking member acts on a compression piston via an articulated linkage, wherewith the articulated linkage is in the form of a six-point articulated linkage configured such that the cocking member is swingably mounted to the firing system via the first articulation point, and has a link member swingably connected to it at a second articulation point borne on said cocking member, wherewith the other end of the link member engages one end of a rod (which is a piston rod or piston plunger) which rod bears a fourth articulation point via which it engages a toggle arm the other end of which toggle arm is connected to the said firing system via a fifth articulation point, and wherewith the sixth articulation point is provided either on the other end of the piston-rod or piston-plunger rod or on the bottom of the cylinder of the pressure-producing piston-and-cylinder device. Advantageously, the first and fifth articulation points may coincide. Toothed segments may be employed to mechanically relieve the six-point linkage in the high pressure region.

5 Claims, 3 Drawing Sheets

COCKING DEVICE FOR A COMPRESSED AIR WEAPON

BACKGROUND OF THE INVENTION

The invention relates to a cocking device for a compressed air weapon employing pre-compressed air, wherein a cocking member acts on a compression piston via an articulated linkage, wherewith said cocking member is swingably mounted on a fixed pivot on the firing system of the weapon, and wherewith the mechanical lever advantage represented by the said linkage increases with increasing compression force of the piston.

In known compressed air weapon cocking devices of this type, one end of the cocking member is swingably mounted on the firing system of the weapon at a fixed pivot point. A connecting rod (piston rod) is swingably connected to the cocking member at an intermediate point of said cocking member. The other end of said rod is connected to the compression piston disposed in the compression cylinder. The cocking device can be improved by providing a slot in the cocking member in which slot the joint at the end of the connecting rod (piston rod) is slidably guided, whereby the mechanical lever advantage increases as the compression force increases. With this arrangement, when the end of the cocking stroke is approached the cocking member undergoing a given swing angle will produce a smaller excursion of the compression piston. This is advantageous.

However, it is disadvantageous to have the improvement provided by a mere slot in the cocking member, because of the undesirable friction. In addition, the known cocking devices occupy excessive space, and have levers which are too long to be accommodated in short compressed air weapons such as air pistols.

SUMMARY OF THE INVENTION

Accordingly, the underlying problem of the invention is to devise an articulated linkage for the cocking device wherein friction is controlled and the space requirements on the weapon and for the linkage are minimal.

According to the invention, a six-point articulated linkage is employed wherein the cocking member is linked to the piston plunger (or piston rod) by means of a link member and a toggle arm. This reproduces the advantageous effect of a large excursion of the piston for a given swing angle of the cocking member at the beginning of the cocking stroke, and a small excursion of the piston for a given swing angle of the cocking member near the end of the cocking stroke (which is the high pressure region). This optimizes the cocking operation for the user, with the cocking force required to be exerted on the cocking member being low throughout the stroke. The result is materially aided by the low friction of the six-point kinematic linkage.

With the inventive structure it is also possible for the fixed pivot of the cocking member (fixed to the firing system) to be at the same location as the end pivot of the toggle arm which is thus also fixed. This results in additional savings of the space required on the weapon and for the cocking linkage.

Optional toothed segments on the cocking arm and connecting rod which intermesh in the high pressure regime near the end of the cocking stroke result in absorption of forces on these structures, with consequent relief of the loads on the joints.

Additional details, advantages, and features of the invention are apparent from the drawings, to which express reference is made here as to disclosure of all details which may be essential to the invention and are not described in detail hereinbelow.

DESCRIPTION OF PREFERRED EMBODIMENTS

Figure 1:
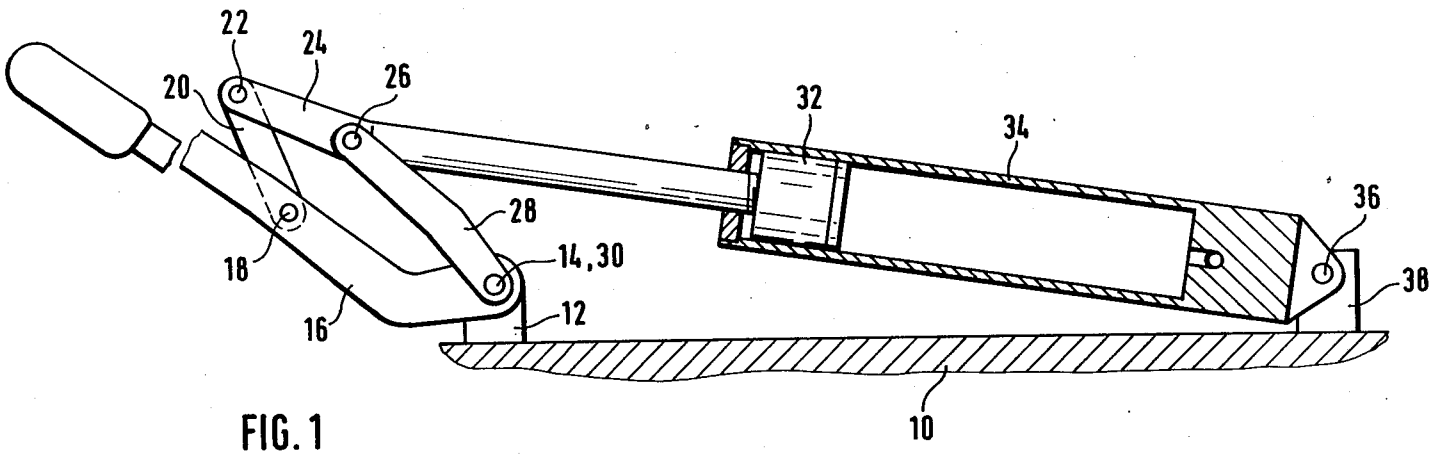

FIG. 1 shows a symbolically depicted firing system 10 of the weapon. A first bearing bracket 12 is rigidly affixed to the system 10, and bears one end of a cocking member 16 at a first articulation point 14. The member 16 may be a cocking lever, as shown in FIG. 1. Obviously, the cocking member 16 may be a top, bottom, or side cocking lever. It may also have other weapon parts integrated into it, in which case it may have a different form than that of a cocking lever. At a distance from the first articulation point 14 the cocking member 16 has a second articulation point 18, where one end of a link member 20 is connected to the cocking member 16. The other end of member 20 has a third articulation point 22. Here (at 22) the link member 20 is connected to a rod 24, which in the embodiment shown is a piston plunger. The rod 24 has a fourth articulation point 26 at a distance from the third articulation point 22. A toggle arm 28 engages rod 24 at points 26. The other end of toggle arm 28 is connected to a fifth articulation point 30 which is also immovable with respect to the system 10.

Figure 2:
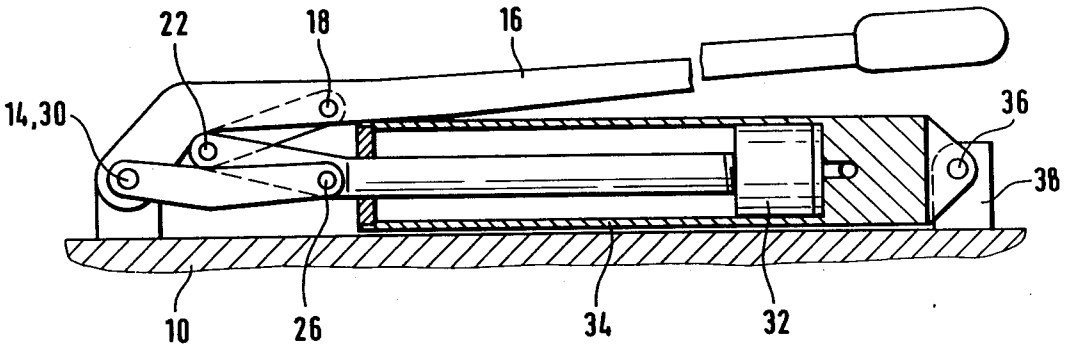
FIGS. 1 and 2 show a first embodiment of the invention, in side elevation in an open and a closed position, respectively.

It is seen immediately that the first and fifth articulation points coincide in the exemplary embodiment shown in FIGS. 1 and 2; thus both joints can be supported on the bearign bracket 12 on the system 10.

Rod 24, which is a piston plunger, is connected to the piston 32 operating in cylinder 34. The bottom of cylinder 34 is pivotably mounted to system 10 via a bearing bracket 38, namely at a sixth articulation point 36.

It is apparent to one skilled in the art that the engineering of the selected articulated linkage itself, with determination of the locations of various points, e.g.:

- the disposition of the second articulation point on the cocking member 16,
- the distance of the second articulation point 18 from the first articulation point 14, and
- the length of the toggle arm 28 (thus the distance of the fourth articulation point from the fifth articulation point), is a routine exercise. Therefore, these length relationships are other details will not be discussed further here. Rather, they will be chosen based on the anticipated conditions of use of the given weapon and other discretionary factors, e.g. as relates to the length of the stroke.

Figure 4:
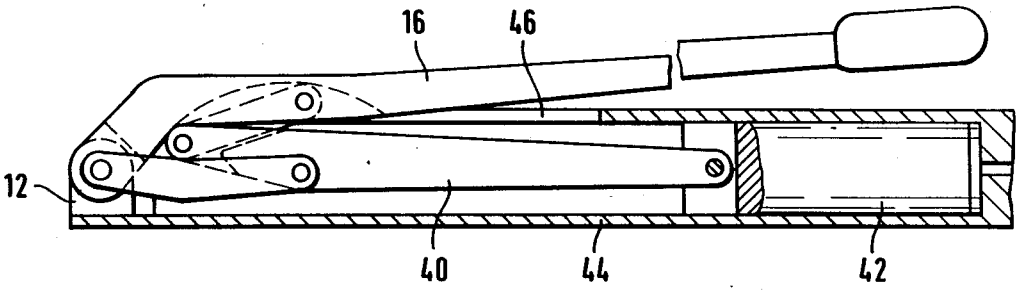
FIGS. 3 and 4 are corresponding views to FIGS. 1 and 2 of a second embodiment.
Figure 3:
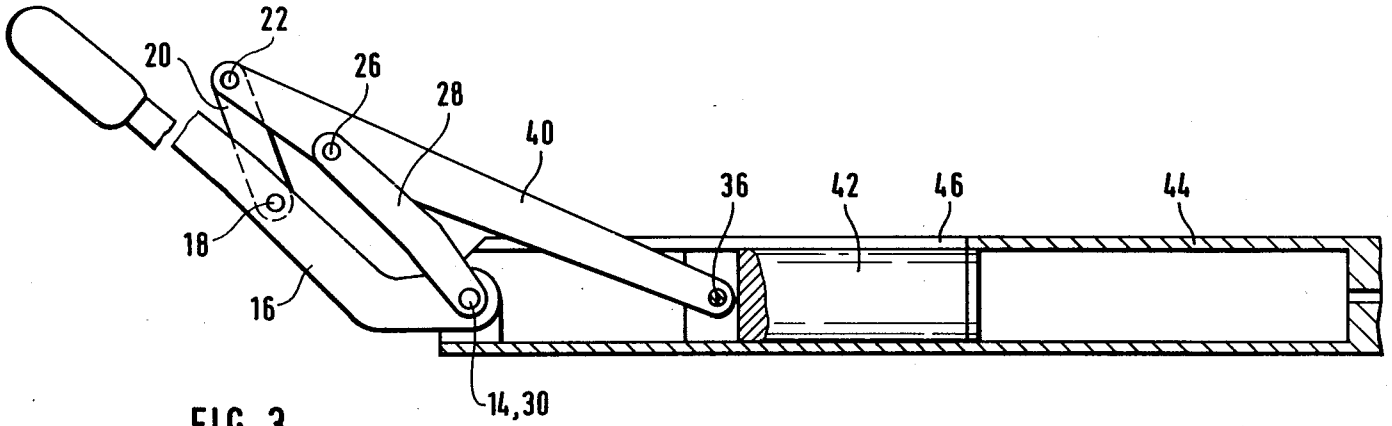

In the embodiment according to FIGS. 3 and 4, the arrangement of the cocking member 16, link member 20, and toggle arm 28 is the same as in the embodiment illustrated in FIGS. 1 and 2. Here, however, the piston plunger 24 has been replaced by a piston rod 40. As was described above with regard to plunger 24, piston rod 40 bears the articulation points 22 and 26. The sixth articulation point 36 is here on the other end of piston rod 40, namely where rod 40 joins the piston 42. The cylinder 44 in which the piston 42 travels is fixedly integrated into the system. A slot is present on the upper side of cylinder 44, to enable the piston rod 40 to extend through the cylinder wall. Accordingly, the piston 42 is elongated in comparison to the piston of the embodiment according to FIGS. 1 and 2, as can be seen from the Figures. The embodiment according to FIGS. 3 and 4 otherwise corresponds to that according to FIGS. 1 and 2.

Figure 6:
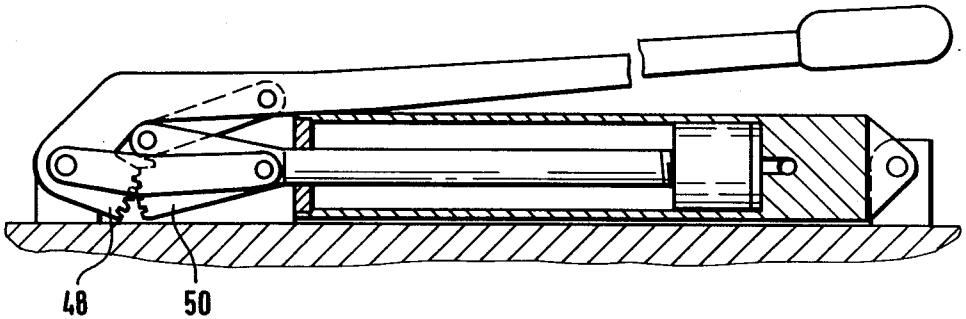
FIGS. 5 and 6 are corresponding views to FIGS. 1 and 2 of a third embodiment.
Figure 5:
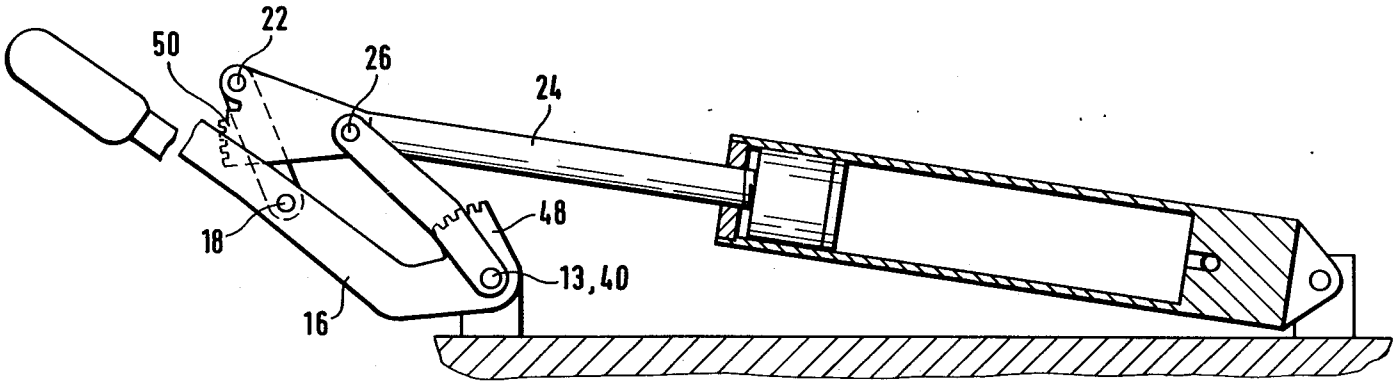

FIGS. 5 and 6 show an embodiment which is very similar to that according to FIGS. 1 and 2. However, there is an additional feature. On the cocking member 16 in the region of its pivot (which pivot is at the first articulation point) a toothed segment 48 is provided. Another toothed segment 50 is provided on the rod 24 in the region between the third articulation point 22 and the fourth articulation point 26, as shown in FIG. 5. The configuration of these toothed segments is such that the center of the circular segment represented by toothed segment 48 is the first articulation point 14 (and the coincident fifth articulation point 30), and the center of the circular segment represented by toothed segment 50 is the fourth articulation point 26.

It may be seen clearly from FIG. 5 that the two toothed segments (48, 50) are completely out of conatct with each other when the cocking member is open, i.e. at the beginning of the cocking stroke. FIG. 6 illustrates how, when the cocking member 16 is closed (swung against the firing system), the two toothed segments (48, 50) become mutually engaged and meshed. The toothed segments (48, 50) are disposed such that they begin to intermesh near the end of the cocking stroke, and the mutual thrust of said segments accommodate forces which occur in the six-point articulated mechanism, thereby relieving stress on the articulation points.

We claim:

1. A cocking assembly in combination with a compression assembly of a compressed air weapon having a rod extending from a piston of the compression assembly, the cocking assembly comprising a cocking member pivotally connected to the weapon, a link member pivotally connected to one end thereof to the cocking member and at an opposite end thereof to said rod, and a toggle arm having one end pivotally connected to the weapon and another end pivotally connected to the rod between the connection thereto of the link member and the piston.

2. The assembly of claim 1 wherein the piston is received in a cylinder pivotally mounted on the weapon.

3. The assembly of claim 1 wherein the rod is pivotally attached to the piston.

4. The assembly of claim 1 wherein the cocking member and the toggle arm are pivotally connected to the weapon on a common pivot axis.

5. The assembly of claim 1 further including a first toothed segment on the rod and a second toothed segment on the cocking member for meshing with the first segment as the piston approaches an end of a cocking stroke, the first segment having a center corresponding with a pivot connection between the toggle arm and the rod, the second segment having a center corresponding with a pivot connection between the cocking member and the weapon.

* * * * *